US006217360B1

(12) United States Patent
Parent

(10) Patent No.: US 6,217,360 B1
(45) **Date of Patent: *Apr. 17, 2001**

(54) CONNECTOR LOCK

(75) Inventor: Charles L. Parent, Eatontown, NJ (US)

(73) Assignee: Paradyne Corporation, Largo, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/322,380

(22) Filed: May 28, 1999

Related U.S. Application Data

(60) Provisional application No. 60/087,346, filed on May 29, 1998.

(51) Int. Cl.[7] ..... H01R 13/625
(52) U.S. Cl. ..... 439/341
(58) Field of Search ..... 439/341, 376, 439/362, 322, 326, 333

(56) References Cited

U.S. PATENT DOCUMENTS 3,617,985 * 11/1971 Kehl ..... 439/341
4,257,665 * 3/1981 John et al. ..... 439/341
5,302,136 * 4/1994 St. Germain et al. ..... 439/341
5,607,319 * 3/1997 Wakata et al. ..... 439/341
5,711,682 * 1/1998 Maejima ..... 439/341
5,966,023 * 10/1999 Burgers et aL. ..... 439/341

OTHER PUBLICATIONS

Catelog excerpts for AMP regarding Miniature Ribbon Connector System (CHAMP) products; pp. 31, 34, and 39, Aug. 1994.
Specifications brochure produced by CINCH regarding latching and mounting options for Miniature Ribbon and Superibbon products; 2 pgs.
Catelog excerpts for AMP regarding Miniature Ribbon Connector System (CHAMP) products; pp. 31, 34, and 39, Aug. 1994.

* cited by examiner

*Primary Examiner*—Tulsidas Patel
(74) *Attorney, Agent, or Firm*—Thomas, Kayden, Horstemeyer & Risley

(57) ABSTRACT

The present invention relates to a connector lock for locking a first electrical connector to a second electrical connector. The connector lock comprises a first mounting bracket adapted to mount to the first electrical connector and a second mounting bracket adapted to mount to the second electrical connector. The second mounting bracket is pivotally displaceable with respect to the first mounting bracket such that the second mounting bracket can be pivoted relative to the first mounting bracket to align mating portions of the first and second electrical connectors.

14 Claims, 9 Drawing Sheets

CONNECTOR LOCK

CROSS REFERENCE TO RELATED APPLICATION

This document claims priority to and the benefit of the filing date of co-pending and commonly assigned provisional application entitled CONNECTOR LOCK, assigned Ser. No. 60/087,346, and filed May 29, 1998, which is hereby incorporated by reference.

FIELD OF THE INVENTION

The invention relates generally to locking electrical connectors together. More particularly, the present invention relates to locking free plugs to chassis mounted receptacles.

BACKGROUND OF THE INVENTION

Mechanical fastening devices are needed to ensure positive connection between mating connectors to avoid accidental decoupling and loss of electrical connection. Several mechanical devices have been developed for locking connectors together. In one common example, threaded fasteners such as screws are provided on both ends of a free plug. These fasteners are adapted to be received by threaded apertures provided in the mating connector, typically a chassis mounted receptacle. Although simple in design and generally effective in locking the two connectors together, auxiliary locking means are necessary when the plug comprises an end fed connector. The reason for this is because the cable to which the end fed connector is attached occupies the space in which a threaded fastener would be used to secure the cable end of the connector to the chassis mounted receptacle. Accordingly, when locking an end fed connector to such a receptacle, the free end of the connector normally is secured to the receptacle with a threaded fastener while the cable end of the connector normally is secured in place with a cable tie. Although such an arrangement is effective once in place, the locking process can be difficult. In particular, the tightly packed arrangement in which such end fed connectors are used makes it difficult for the operator to secure the cable tie in place. Moreover, often times additional mounting hardware is needed if such cable ties are to be used. Another disadvantage is that, once the connector plug is locked in place with the threaded fastener and the cable tie, the plug can only be removed by severing the cable tie. Hence, a new cable tie must be used if the connector plug is to be again locked to the chassis mounted receptacle.

In other designs, plugs are secured to mating chassis mounted receptacles with bailing clips. Such bailing clips typically take the form of metal wires that are adapted to wrap around a boss or mating bailing clip provided on the chassis mounted receptacle. Although effective, these bailing clips normally occupy precious chassis space that could be better utilized. In addition, since the bailing clips provided on the plug often are designed to mate with a specific type of boss or other bailing clip, it frequently is necessary for the user to purchase both the plug and receptacle from the same manufacturer, thereby limiting purchase options.

In yet another design, the plug and the chassis mounted receptacle each is provided with specially designed locking tabs. Due to cost and spatial constraints, these locking tabs tend to be slight in design and therefore not capable of providing secure locking between the plug and the chassis mounted receptacle. In addition, like some of the bailing clip systems currently available, both the plug and the chassis mounted receptacle usually must be purchased from the same manufacturer if such locking tabs are used.

From the above, it can be appreciated that it would be desirable to have a connector lock that is simple in both design and operation that securely locks two connectors of any manufacturer such as a plug and a chassis mounted receptacle together.

SUMMARY OF THE INVENTION

The present invention relates to a connector lock for locking a first electrical connector to a second electrical connector. The connector lock comprises a first mounting bracket adapted to mount to the first electrical connector and a second mounting bracket adapted to mount to the second electrical connector. The second mounting bracket is pivotally displaceable with respect to the first mounting bracket such that the second mounting bracket can be pivoted relative to the first mounting bracket to align mating portions of the first and second electrical connectors.

In a preferred arrangement, the connector lock further comprises a fastener that is adapted to extend from the second electrical connector to the first electrical connector to secure the first and second electrical connectors together. In the preferred arrangement, the first mounting bracket comprises a first hook portion and the second mounting bracket comprises a second hook portion, the first and second hook portions being engageable so as to facilitate pivoting of the second mounting bracket relative to the first mounting bracket.

The features and advantages of this invention will become apparent upon reading the following specification, when taken in conjunction with the accompanying drawings. It is intended that all such additional features and advantages be included therein with the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
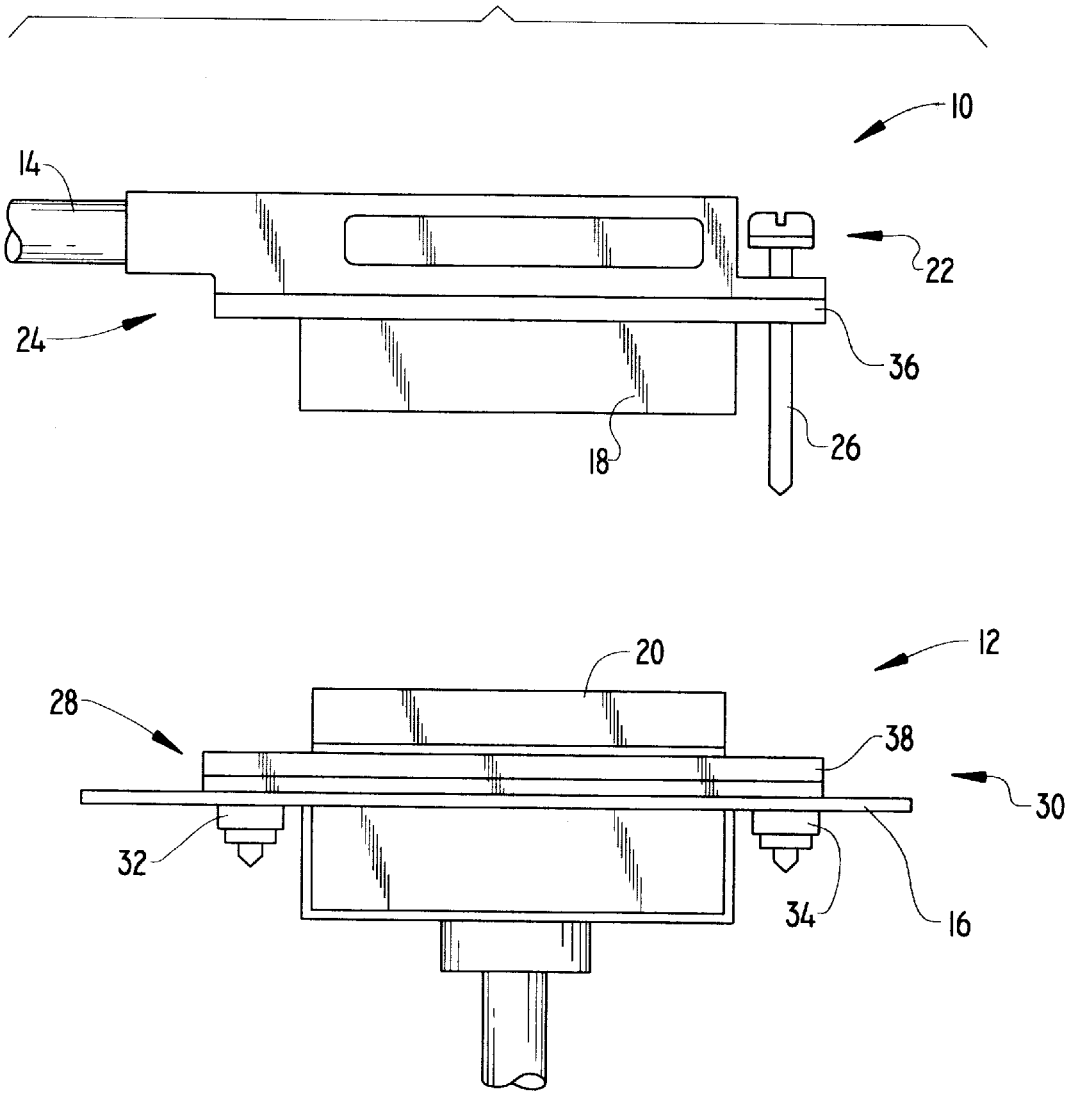
FIG. 1 PRIOR ART
FIG. 1 is a side view of a conventional end fed plug and a conventional chassis mounted receptacle shown prior to their connection.

Referring now in more detail to the drawings, in which like numerals indicate corresponding parts throughout the several views, FIG. 1 shows two conventional connectors 10 and 12 of the type with which the present invention normally is used. It is to be understood, however, that the principles discussed herein are applicable to connectors in general.

FIG. 1 shows a free connector or plug 10 that is adapted to mate with a chassis mounted connector or receptacle 12. The plug 10 is attached to a cable 14, which typically comprises 25 pair cable, and the chassis mounted receptacle 12 is mounted to a chassis 16 which typically forms part of an enclosure housing. Formed on both of the connectors 10, 12 are mating portions 18 and 20, respectively. Normally these mating portions 18, 20 house a plurality of electrical contacts, for example 25 pairs of electrical conductors (not shown). The plug connector 10 comprises a free end 22 and a cable end 24. The free end 22 normally is provided with a threaded fastener 26 such as a screw. The chassis mounted receptacle 12 also normally includes first and second ends 28 and 30. Due to the fact that the receptacle 12 normally is symmetrical about its central axis, these ends 28, 30 usually are mirror images of each other. Each of the first and second ends 28 and 30 typically include threaded fastener receiving elements 32 and 34, which typically comprise threaded apertures. The fastener receiving element 34 provided at the second end 30 of the chassis mounted receptacle 12 is specifically adapted to threadingly receive the threaded fastener 26 of the plug 10. As is conventional in the art, both the plug 10 and the chassis mounted receptacle 12 normally are provided with mounting flanges 36 and 38, respectively. As indicated in FIG. 1, the threaded fastener 26 extends through the mounting flange 36 at the free end 22 of the plug 10. The mounting flange 38 of the chassis mounted receptacle 12 is provided with two holes (not shown) that are aligned with the fastener receiving elements 32, 34 such that fasteners such as the threaded fastener 26 can be passed through the mounting flange and into the fastener receiving elements.

Figure 2:
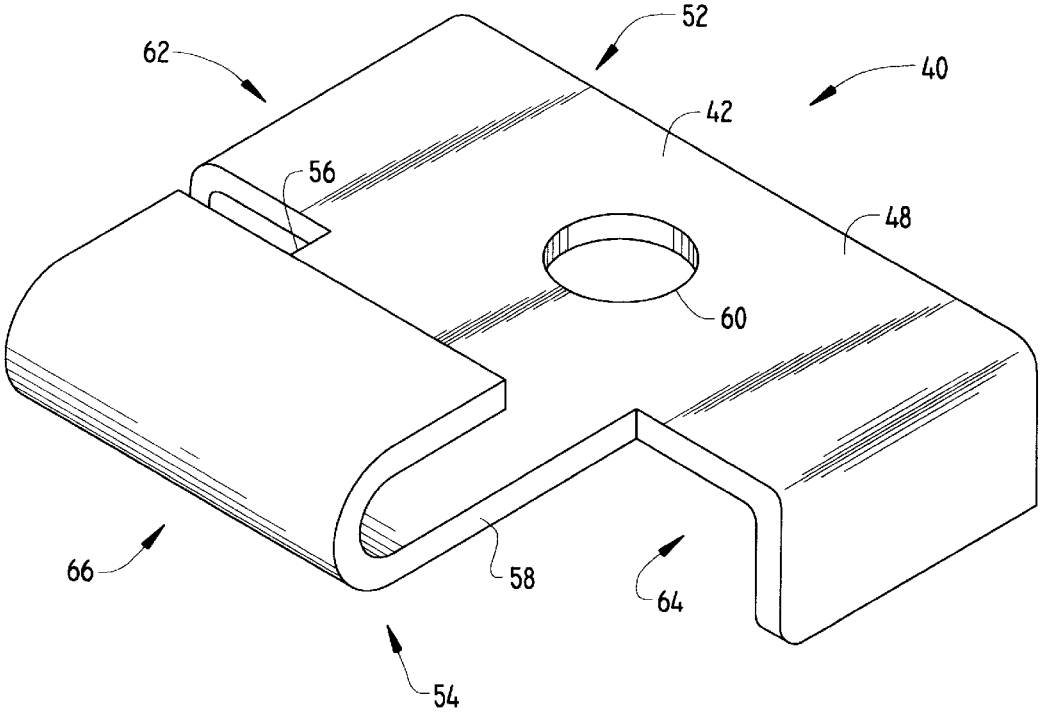
FIG. 2 is a perspective view of a receptacle side mounting bracket.
Figure 3:
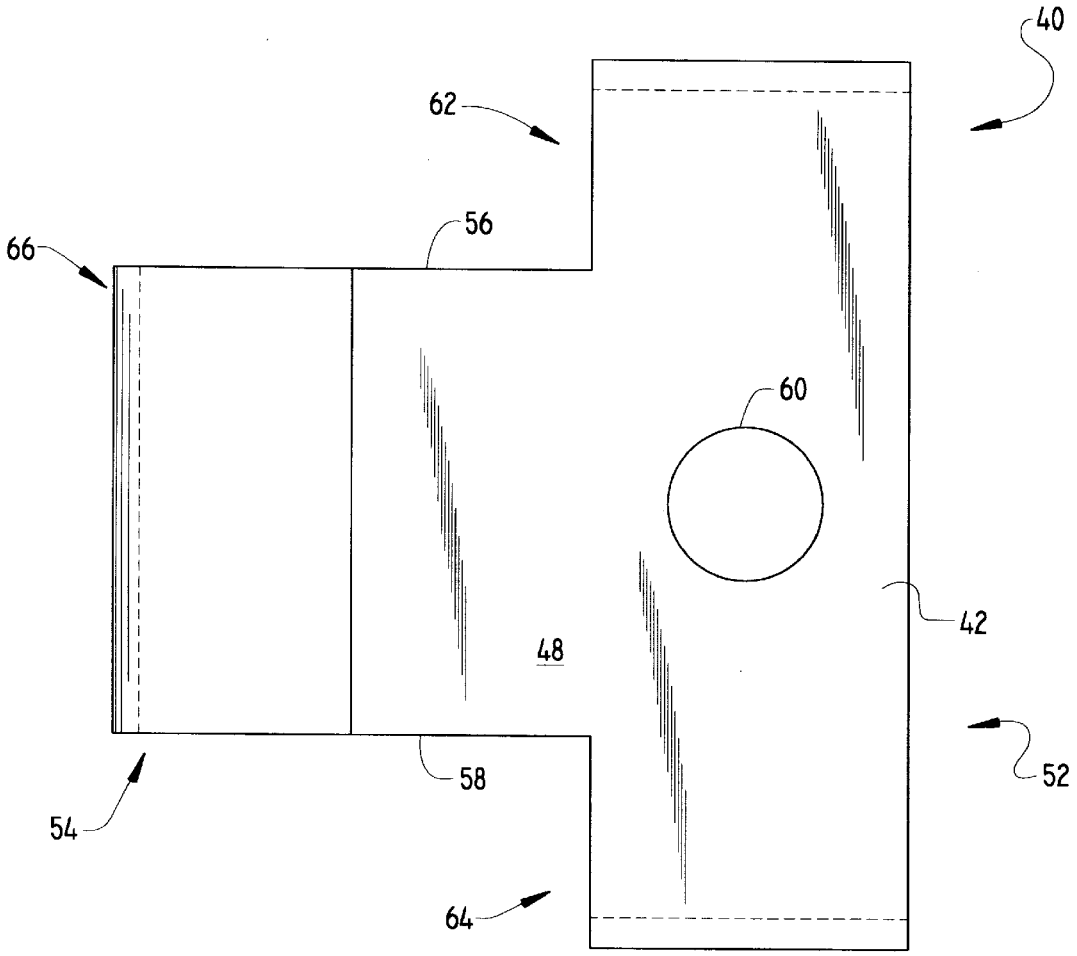
FIG. 3 is a top view of the mounting bracket shown in FIG. 2.
Figure 4:
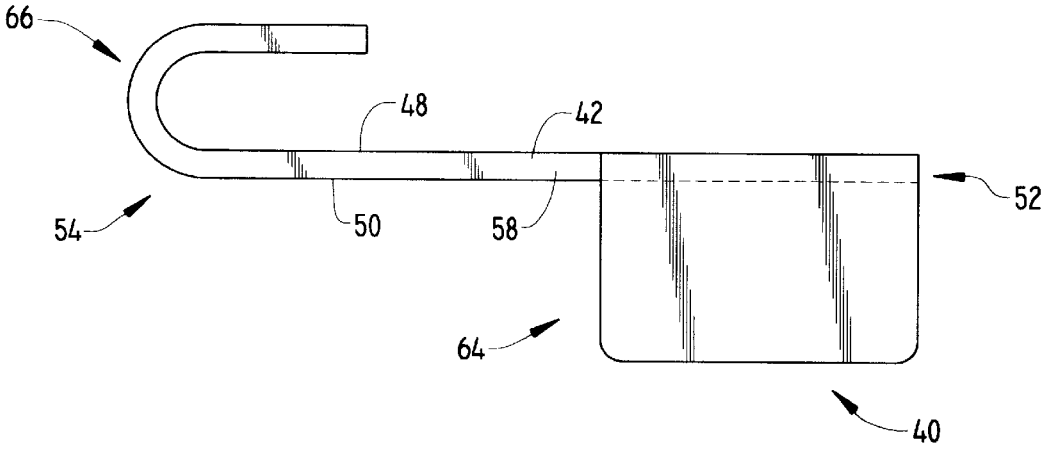
FIG. 4 is a side view of the mounting bracket shown in FIGS. 2 and 3.
Figure 8A:
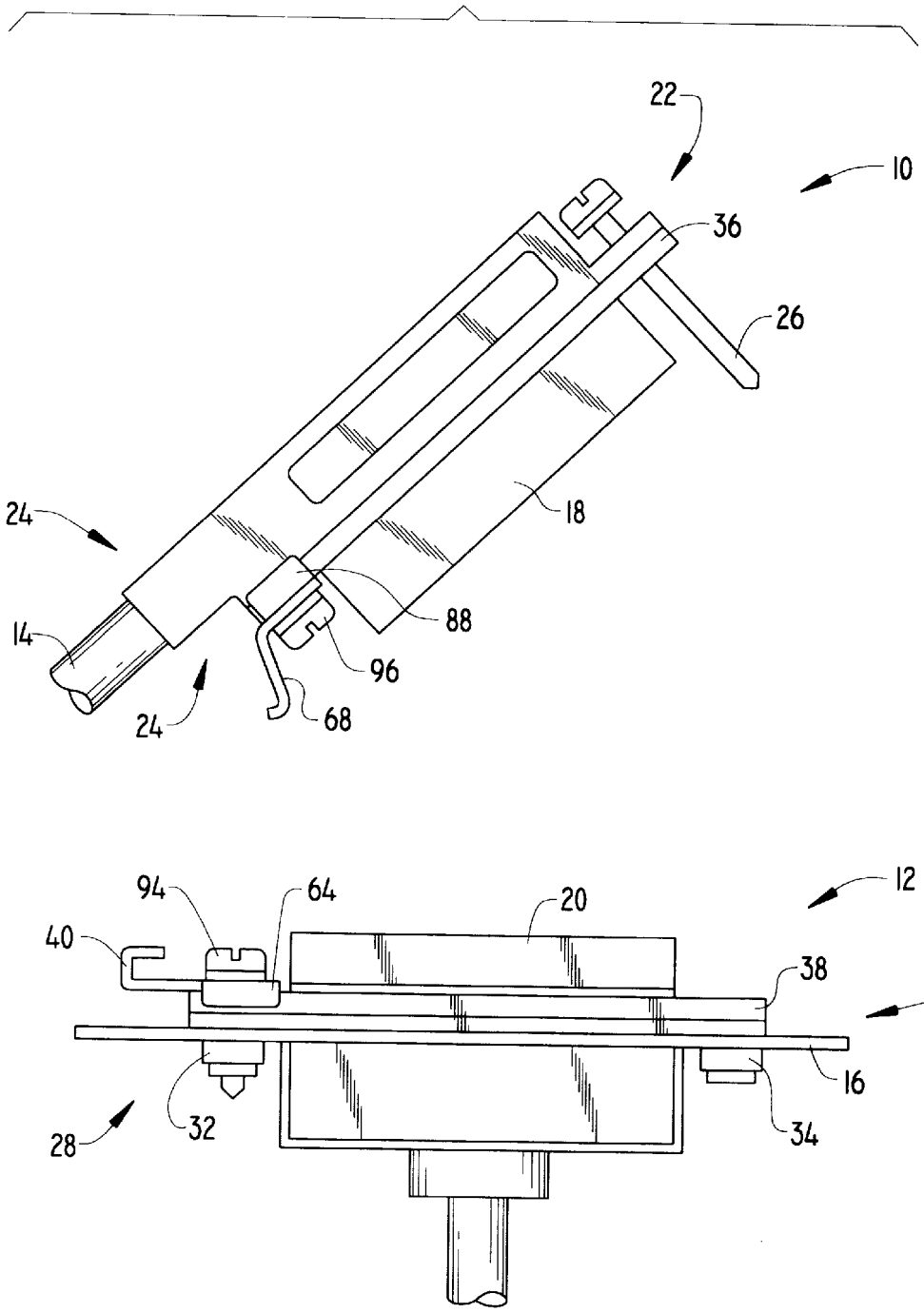
FIG. 8A is a side view showing a first step involved in locking a plug to a chassis mounted receptacle using the mounting brackets shown in FIGS. 1–7.
Figure 8B:
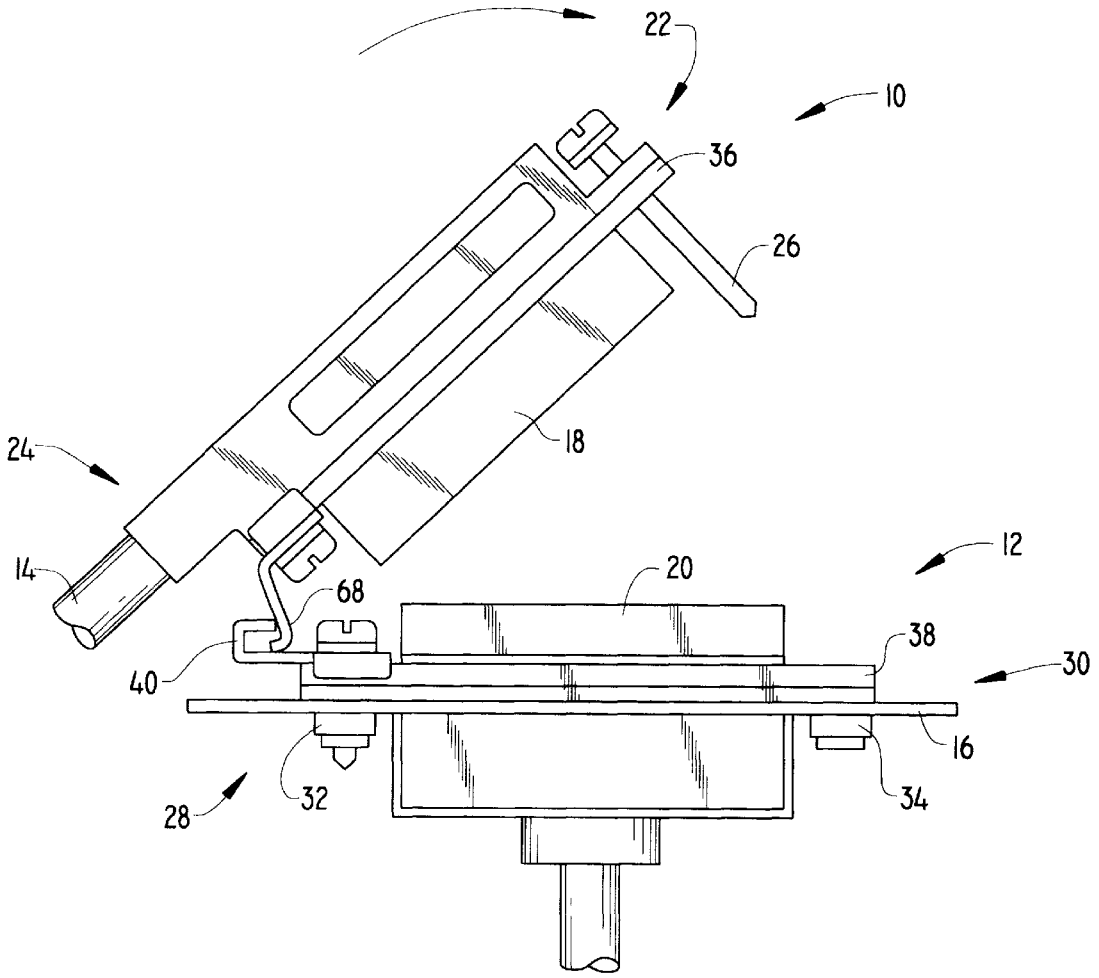
FIG. 8B is a side view showing a second step involved in locking the plug using the mounting brackets shown in FIGS. 1–7.
Figure 8C:
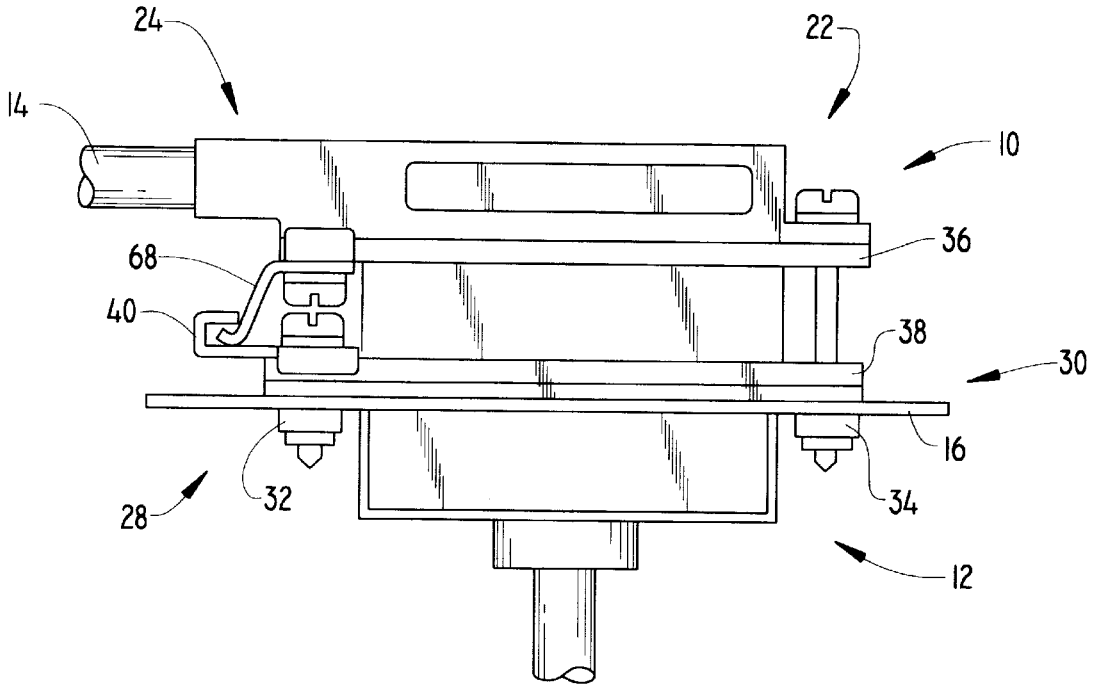
FIG. 8C is a side view showing the plug and receptacle locked together with the mounting brackets shown in FIGS. 1–7.

FIGS. 2–4 illustrate a receptacle side mounting bracket 40. As indicated in these figures, the receptacle side mounting bracket 40 generally comprises a body portion 42 that is substantially planar in shape and which includes a top side 48, a bottom side 50, a proximal end 52, a distal end 54, and lateral edges 56 and 58. Typically, the body portion 42 is composed of a rigid material such as stainless steel. Formed intermediate the proximal and distal ends 52 and 54, and between the lateral edges 56 and 58, is a fastener aperture 60 that is adapted to receive a threaded fastener (FIGS. 8A–8C). Extending outwardly from the lateral edges 56 and 58 of the body portion 42 are opposed flanged portions 62 and 64. These flanged portions 62, 64 typically extend laterally within the same plane of the body portion 42 for a predetermined distance, and then extend downwardly therefrom. Extending upwardly from the distal end 54 of the body portion 42 is a hook portion 66. The hook portion 66 extends upwardly from the body portion 42 and bends backwardly over the body portion to extend toward the fastener aperture 60.

Figure 5:
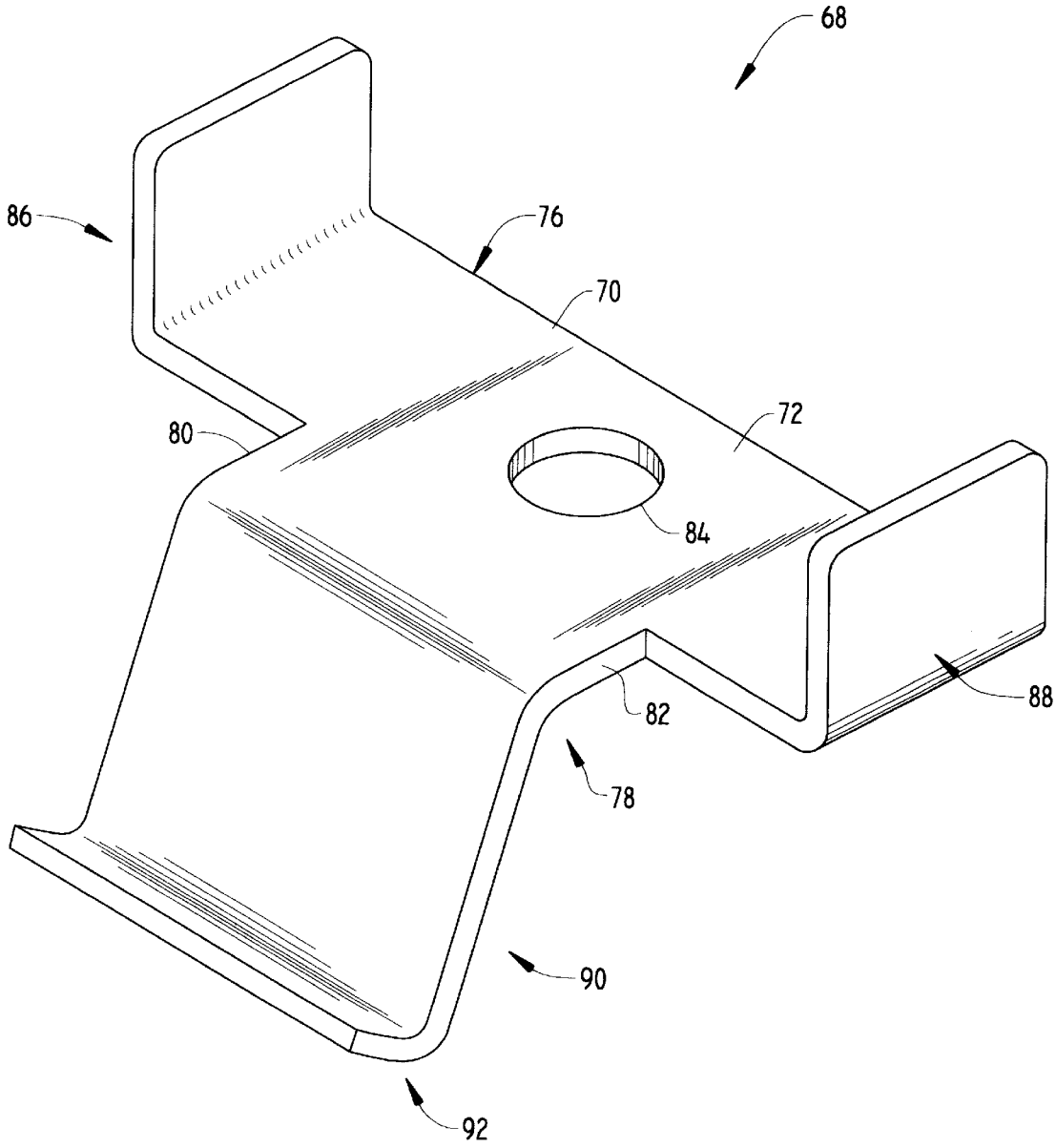
FIG. 5 is a perspective view of a plug side mounting bracket.
Figure 6:
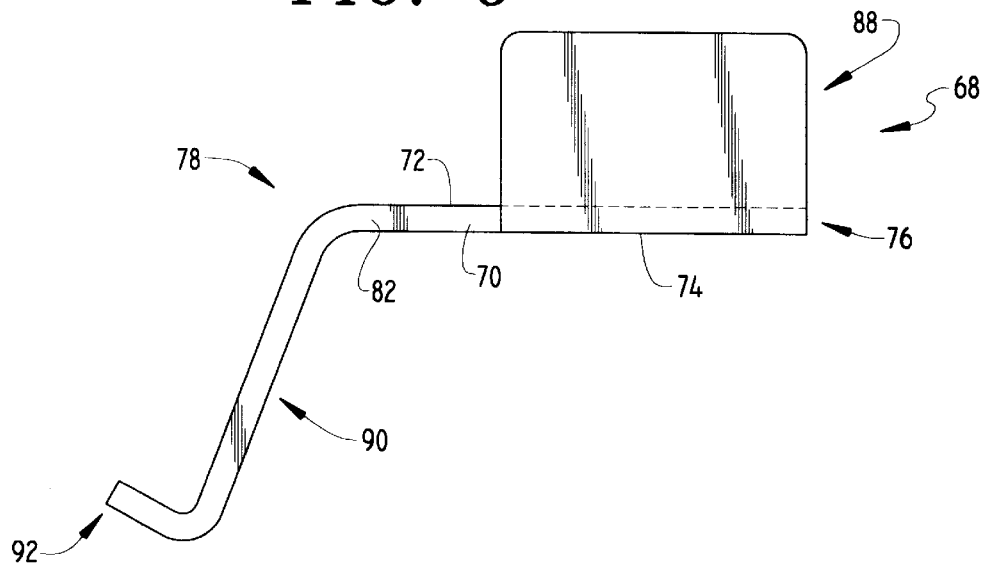
FIG. 6 is a side view of the mounting bracket shown in FIG. 5.
Figure 7:
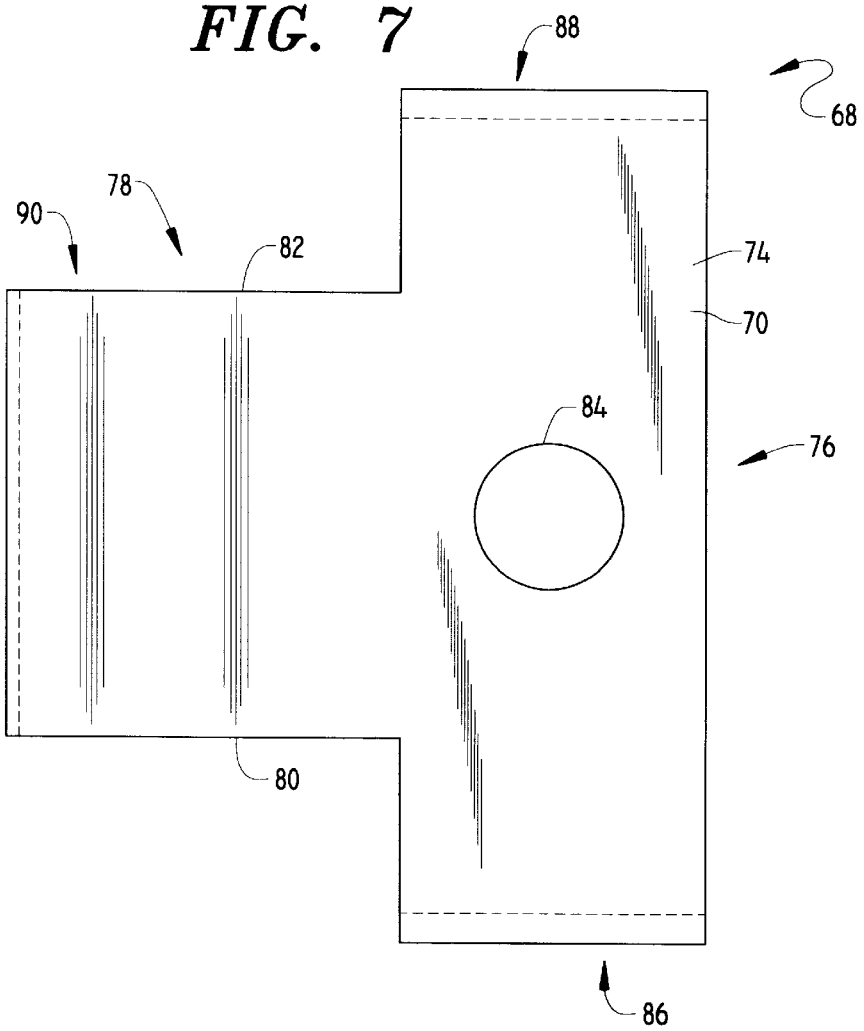
FIG. 7 is a bottom view of the mounting bracket shown in FIGS. 5 and 6.

FIGS. 5–7 illustrate a plug side mounting bracket 68. Similar to the chassis side mounting bracket 40, the plug side mounting bracket 68 comprises a body portion 70 that includes a top side 72, a bottom side 74, a proximal end 76, a distal end 78, and lateral edges 80 and 82. The body portion 70 similarly typically is constructed of a rigid material such as stainless steel. Intermediate the proximal and distal ends 76 and 78, and between the lateral edges 80 and 82, is formed in a fastener opening 84 that is adapted to receive a threaded fastener (FIGS. 8A–8C). Extending outwardly and upwardly from the lateral edges 80, 82 of the body portion 70 of the plug side mounting flange 68 are opposed flanged portions 86 and 88. In particular, these flanged portions 86, 88 extend laterally from the body portion 70 within the same plane thereof, and then extend upwardly therefrom. Extending outwardly and downwardly from the distal end 78 of the body portion 70 is a pivot member 90. As indicated most clearly in FIGS. 5 and 6, the pivot member 90 forms a hook portion 92 that is adapted to interconnect with the hook portion 66 of the receptacle side mounting bracket 40.

The general construction of the mounting brackets 40 and 68 having been described above, the following discussion will describe operation of these mounting brackets in use with a conventional plug and receptacle system such as that shown in FIG. 1. With reference to FIGS. 8A–8C, the receptacle side mounting bracket 40 can be secured to the first end 28 of the chassis mounted receptacle 12 with a threaded fastener 94, such as a screw, that passes through the fastener aperture 60. As indicated in FIG. 8A, the mounting bracket 40 specifically connects to the mounting flange 38 of the chassis mounted receptacle 12 such that the opposed flanged portions 62, 64 wrap around the edges of the mounting flange such that, once the mounting bracket is secured in place, it cannot be rotated out of the position depicted in FIG. 8A. In similar manner, the plug side mounting bracket 68 can be secured to the cable end 24 of the plug connector 10. In particular, the mounting bracket 68 is secured by a threaded fastener 96 that extends through the fastener aperture 84 of the mounting bracket and into the plug connector body. As with the receptacle side mounting bracket 40, the plug side mounting bracket 68 aflixes to the plug connector with its opposed flanged portions 86, 88 wrapping around the edges of the mounting flange 36 of the plug such that the mounting bracket cannot be rotated once affixed in the orientation shown in FIG. 8A.

After the two mounting brackets 40 and 68 have been secured in the manner described above, the plug 10 can be mated with the chassis mounted receptacle 12. To accomplish such mating, the plug side mounting bracket 68 first is hooked to the receptacle side mounting bracket 40 such that the hook portion 92 of the pivot member 90 fits within the hook portion 66 of the receptacle side mounting bracket 40 as indicated in FIG. 8B. After such interconnection has been made, the plug 10 simply can be pivoted about the hook portion 68 of the receptacle side mounting bracket 40 as indicated by the directional arrow shown in FIG. 8B such that the mating portions 18 and 20 of the plug and chassis mounted receptacle are brought into contact with each other. At this point, electrical connection can be made between the plug 10 and the chassis mounted receptacle 12 by urging the mating portion 18 of the plug connector into the mating portion 20 of the chassis mounted receptacle in the conventional manner until the plug and receptacle are fully connected as indicated in FIG. 8C. Once the plug 10 and the receptacle 12 have been coupled as described above, they can be securely locked to each other by threading the threaded fastener 26 into the fastener receiving element 34 provided at the second end 30 of the receptacle.

Figure 9A:
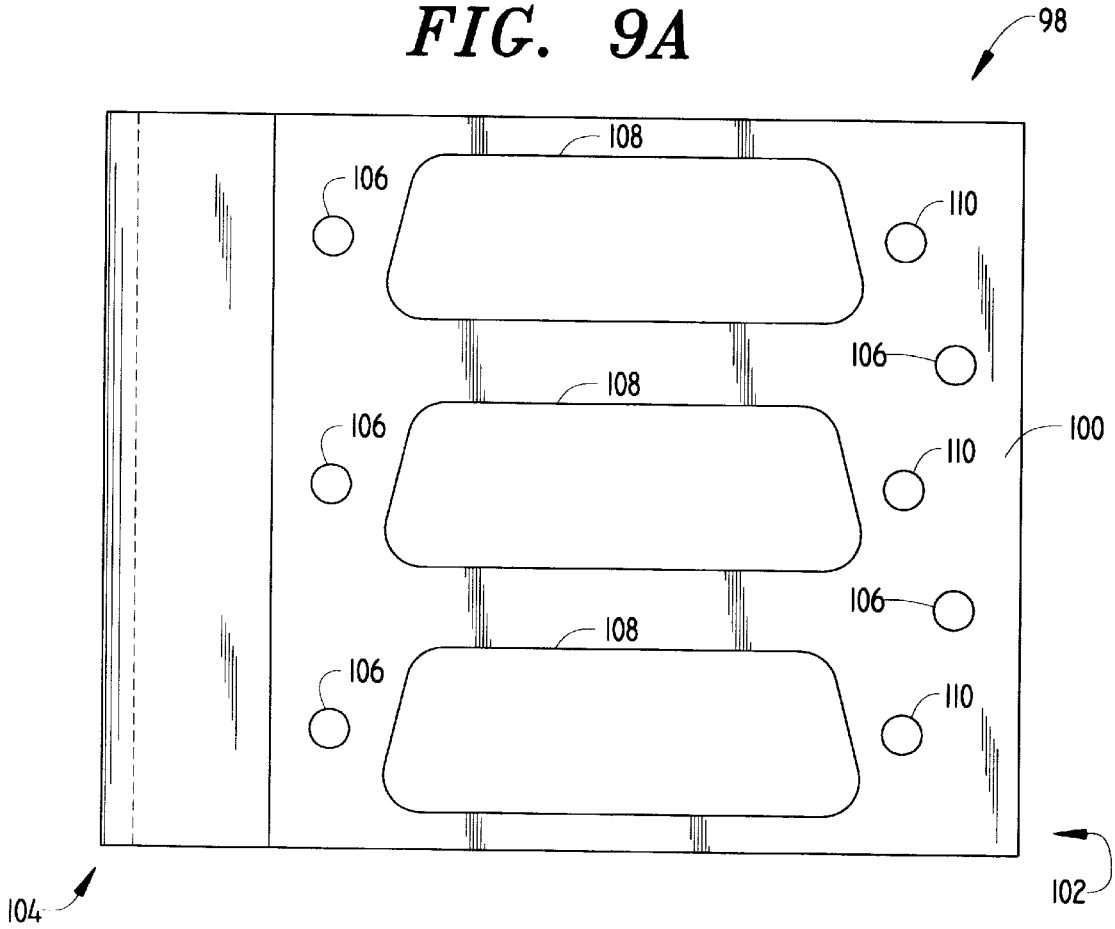
FIG. 9A is an alternative embodiment of a receptacle side mounting bracket.
Figure 9B:
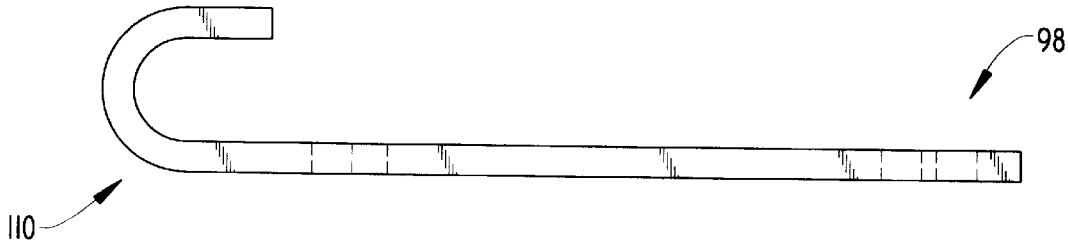
FIG. 9B is a side view of the mounting bracket shown in FIG. 9A.

FIGS. 9A and 9B illustrate a second embodiment of the invention. In particular, these figures illustrate a receptacle side mounting bracket 98 that is adapted to facilitate the locking of a plurality of (for example three) plugs 10 to a plurality of chassis mounted receptacles 12. Like the mounting brackets 40 and 68 described above, the mounting bracket 98 shown in FIG. 9A comprises a body portion 100 that includes first and second ends 102 and 104. Extending through the body portion 100 is a plurality of mounting holes 106, the five outermost of these for securing the bracket 98 to the enclosure housing. Further, provided in the body portion is a plurality of mating portion apertures 108 that are adapted to receive the mating portions 20 of a plurality of chassis mounted receptacles when the bracket 98 is mounted to the housing. As indicated most clearly in FIG. 9B, a hook portion 110 extends upwardly from the second end 104 of the body portion 100. More specifically, the hook portion 110 extends upwardly and backwardly over the body portion 100 towards the mating portion openings 108. In use, the mounting bracket 98 is used in similar manner to the mounting bracket 40. Accordingly, the mounting bracket 98 provides a pivot point for the plug mounting brackets 68 of, in this example, one to three plugs 10 that are to be mounted to chassis mounted receptacles. Once these plugs are connected to their respective receptacles, they can be securely locked in place by tightening threaded fasteners (not shown) that extend through the interior mounting openings 110 provided in the body portion 100 adjacent the mating portion apertures 108.

The connector locks described above provide several advantages not presently realized in the prior art. First, the connector locks described herein are easy to use such that secure connections can be made quickly and without difficulty. Second, the connector locks are low profile in design such that they will not interfere with other electrical hardware present on the enclosure housing, thereby facilitating closely packed arrangement of connector couplings. Further, the connector locks can be utilized with substantially any connector plug and chassis mounted receptacle system such that components made by different manufacturers can be used together. Accordingly, existing systems can be retrofitted with the connector locks of the present invention to provide for secure electrical coupling.

While preferred embodiments of the invention have been disclosed in detail in the foregoing description and drawings, it will be understood by those skilled in the art that variations and modifications thereof can be made without departing from the spirit and scope of the invention as set forth in the following claims.

What is claimed is:

1. A connector lock for locking a first electrical connector to a second electrical connector, said connector lock comprising:

a first mounting bracket including flanged portions that extend laterally for a predetermined distance, and extend downward therefrom, and a first hook portion, wherein said first hook portion extends upwardly from the mounting bracket and bends backwardly over the mounting bracket to extend toward said flanged portions, and wherein said first mounting bracket is adapted to mount to the first electrical connector;

a second mounting bracket including flanged portions that extend laterally from the mounting bracket within the same plane thereof, and then extend upwardly therefrom, and a second hook portion, wherein said second hook portion extends outwardly and downwardly from said second mounting bracket, and wherein said second mounting bracket is adapted to mount to the second electrical connector, said first and second hook portions being engageable so as to facilitate pivoting of said second mounting bracket relative to said first mounting bracket, to align mating portions of the first and second electrical connectors; and a fastener adapted to extend from the second mounting bracket to the first mounting bracket to secure the first and second mounting brackets together.

2. The connector lock of claim 1, wherein said fastener comprises a threaded fastener.

3. The connector lock of claim 1, wherein said first and second mounting brackets are adapted to be secured to the first and second electrical connectors, respectively, with threaded fasteners.

4. The connector lock of claim 3, wherein said first and second mounting brackets include fastener apertures that receive said threaded fasteners used to secure said mounting brackets to said electrical connectors.

5. The connector lock of claim 1, wherein said first and second mounting brackets include flanged portions that are adapted to fit about the first and second electrical connectors to maintain proper bracket orientation relative to the electrical connectors.

6. A connector lock for locking a free plug to a chassis mounted receptacle, said connector lock comprising:

a receptacle side mounting bracket including flanged portions that extend laterally for a predetermined distance, and extend downward therefrom, and a first hook portion, wherein said first hook portion extends upwardly from the mounting bracket and bends backwardly over the mounting bracket to extend toward said flanged portions, and wherein said receptacle side mounting bracket is adapted to mount to the chassis mounted receptacle;

a plug side mounting bracket including flanged portions that extend laterally from the mounting bracket within the same plane thereof, and then extend upwardly therefrom, and a second hook portion, wherein said second hook portion extends outwardly and downwardly from said second mounting bracket, and wherein said plug side mounting bracket is adapted to mount to the free plug, said plug side mounting bracket being pivotally displaceable with respect to said receptacle side mounting bracket such that said plug side mounting bracket can be pivoted relative to said receptacle side mounting bracket to align mating portions of the plug and receptacle, wherein said first and second hook portions of the mounting brackets engage so as to facilitate pivoting of said plug side mounting bracket relative to said receptacle side mounting bracket; and a fastener adapted to extend from the free plug to the chassis mounted receptacle to secure the plug and receptacle together.

7. The connector lock of claim 6, wherein said fastener comprises a threaded fastener.

8. The connector lock of claim 6, wherein said plug and receptacle side mounting brackets are adapted to be secured to the plug and receptacle, respectively, with threaded fasteners.

9. The connector lock of claim 8, wherein said plug and receptacle side mounting brackets include fastener apertures that receive said threaded fasteners.

10. The connector lock of claim 6, wherein said plug and receptacle side mounting brackets include flanged portions that are adapted to fit about the plug and receptacle, respectively, to maintain proper bracket orientation relative to the plug and receptacle.

11. A connector coupling, comprising:

an end fed plug having a mounting flange and a first mating portion;

a chassis mounted receptacle having a mounting flange and a second mating portion;

a connector lock for locking said end fed plug to said chassis mounted receptacle, said connector lock including a receptacle side mounting bracket which includes flanged portions that extend laterally for a predetermined distance, and extend downward therefrom, and a first hook portion, wherein said first hook portion extends upwardly from the mounting bracket and bends backwardly over the mounting bracket to extend toward said flanged portions, and wherein said receptacle side mounting bracket is mounted to said mounting flange of said chassis mounted receptacle and a plug side mounting bracket which includes flanged portions that extend laterally from the mounting bracket within the same plane thereof, and then extend upwardly therefrom, and a second hook portion, wherein said second hook portion extends outwardly and downwardly from said second mounting bracket, and wherein said plug side mounting bracket is mounted to said mounting flange of said end fed plug, said plug side mounting bracket being pivotally displaceable with respect to said receptacle side mounting bracket such that said plug can be pivoted relative to said receptacle to align said mating portions of said plug and said receptacle, wherein said first and second hook portions of the mounting brackets engage so as to facilitate pivoting of said plug side mounting bracket relative to said receptacle side mounting bracket; and a fastener extending through said mounting flange of said end plug into said mounting flange of said chassis mounted receptacle to secure said plug and said receptacle.

12. The coupling of claim 11, wherein said plug and receptacle side mounting brackets are secured to said plug and said receptacle, respectively, with threaded fasteners.

13. The coupling of claim 12, wherein said plug and receptacle side mounting brackets include fastener apertures that receive said threaded fasteners.

14. The coupling of claim 11, wherein said plug and receptacle side mounting brackets further include flanged portions fit about opposed sides of said mounting flanges of said plug and said receptacle, respectively, to maintain proper bracket orientation relative to said plug and said receptacle.

* * * * *